US011554378B2

(12) United States Patent
Wheeler et al.

(10) Patent No.: US 11,554,378 B2
(45) Date of Patent: Jan. 17, 2023

(54) FLOTATION OILS, PROCESSES AND USES THEREOF

(71) Applicant: ENVIROLLEA INC., Calgary (CA)

(72) Inventors: Lucie B. Wheeler, Calgary (CA); Charles Wheeler, Calgary (CA)

( * ) Notice: Subject to any disclaimer, the term of this patent is extended or adjusted under 35 U.S.C. 154(b) by 0 days.

(21) Appl. No.: 17/426,093

(22) PCT Filed: Feb. 4, 2020

(86) PCT No.: PCT/CA2020/050129
§ 371 (c)(1),
(2) Date: Jul. 27, 2021

(87) PCT Pub. No.: WO2020/160647
PCT Pub. Date: Aug. 13, 2020

(65) Prior Publication Data

US 2022/0040708 A1 Feb. 10, 2022

(30) Foreign Application Priority Data

Feb. 4, 2019 (CA) ..... CA 3032769

(51) Int. Cl.
*B03D 1/006* (2006.01)
*B03D 1/02* (2006.01)

(52) U.S. Cl.
CPC ..... *B03D 1/006* (2013.01); *B03D 1/02* (2013.01); *B03D 1/021* (2013.01); *B03D 2201/02* (2013.01); *B03D 2203/04* (2013.01); *B03D 2203/06* (2013.01); *B03D 2203/10* (2013.01)

(58) Field of Classification Search
CPC ..... B03D 1/001; B03D 1/006; B03D 1/02; B03D 1/08; B03D 1/082; B03D 1/085; B03D 1/087; B03D 2201/02; B03D 2203/04; B03D 2203/06; B03D 2203/10; C22B 1/00
USPC ..... 209/171
See application file for complete search history.

(56) References Cited

U.S. PATENT DOCUMENTS 1,518,938 A 12/1924 Nielsen
1,877,987 A 9/1932 Schonberg
2,023,942 A 12/1935 Wescott
2,303,931 A * 12/1942 Greene ..... B03D 1/008 252/61
2,785,115 A 3/1957 Borch
3,807,936 A 4/1974 Vering
4,014,643 A 3/1977 Musha et al.
(Continued)

FOREIGN PATENT DOCUMENTS

AU 2012200549 A1 * 3/2012 ..... B01D 21/0012
CA 1099507 4/1981
(Continued)

OTHER PUBLICATIONS

English Abstract of JP2007040615(A), "Rotary Kiln", published on Feb. 15, 2007.
(Continued)

*Primary Examiner* — Joseph C Rodriguez
(74) *Attorney, Agent, or Firm* — Bereskin & Parr LLP/S.E.N.C.R.L., s.r.l.

(57) ABSTRACT

The present disclosure relates to flotation oils, processes for making such flotation oils, and uses thereof for example in the froth flotation of ores such as sylvinite ores to recover potassium chloride.

13 Claims, 1 Drawing Sheet

(56) References Cited

U.S. PATENT DOCUMENTS

| | | | | |
|---|---|---|---|---|
| 4,039,130 | A | 8/1977 | Hogan | |
| 4,090,972 | A * | 5/1978 | Wang | B03D 1/008 252/61 |
| 4,128,475 | A * | 12/1978 | Wang | B03D 1/008 209/166 |
| 4,131,418 | A | 12/1978 | Kramm et al. | |
| 4,180,455 | A | 12/1979 | Taciuk | |
| 4,192,737 | A | 3/1980 | Thompson et al. | |
| 4,280,879 | A | 7/1981 | Taciuk | |
| 4,285,773 | A | 8/1981 | Taciuk | |
| 4,337,149 | A * | 6/1982 | Escalera | B03D 1/008 252/61 |
| 4,411,074 | A | 10/1983 | Daly | |
| 4,427,637 | A | 1/1984 | Iwashita et al. | |
| 4,439,209 | A | 3/1984 | Wilwerding et al. | |
| 4,473,464 | A | 9/1984 | Boyer et al. | |
| 4,475,886 | A | 10/1984 | Tyler | |
| 4,512,873 | A | 4/1985 | Escher et al. | |
| 4,591,362 | A | 5/1986 | Yudovich et al. | |
| 4,737,273 | A * | 4/1988 | Snow | B03D 1/021 252/61 |
| 4,746,420 | A | 5/1988 | Darian et al. | |
| 4,846,677 | A | 7/1989 | Crivelli et al. | |
| 4,872,954 | A | 10/1989 | Hogan | |
| 4,931,171 | A | 6/1990 | Piotter | |
| 4,961,391 | A | 10/1990 | Mak et al. | |
| 5,194,069 | A | 3/1993 | Soméus | |
| 5,316,743 | A | 5/1994 | LeBlanc et al. | |
| 5,366,595 | A | 11/1994 | Padgett et al. | |
| 5,423,891 | A | 6/1995 | Taylor | |
| 5,821,396 | A | 10/1998 | Bouziane | |
| 6,203,765 | B1 | 3/2001 | Taciuk et al. | |
| 6,589,417 | B2 | 7/2003 | Taciuk et al. | |
| 7,354,462 | B2 | 4/2008 | O'Rear | |
| 7,550,063 | B2 | 6/2009 | Gawad | |
| 7,943,014 | B2 | 5/2011 | Berruti et al. | |
| 8,298,406 | B2 | 10/2012 | Coates et al. | |
| 8,394,240 | B2 | 3/2013 | Rinker | |
| 8,534,464 | B2 * | 9/2013 | Pedain | B03D 1/02 252/61 |
| 8,999,147 | B2 | 4/2015 | Wheeler | |
| 9,458,391 | B2 | 10/2016 | Wheeler | |
| 9,555,342 | B2 | 1/2017 | Wheeler | |
| 9,828,553 | B2 | 11/2017 | Wheeler | |
| 2002/0029996 | A1 | 3/2002 | Taciuk et al. | |
| 2004/0231237 | A1 | 11/2004 | Boer et al. | |
| 2005/0167337 | A1 | 8/2005 | Bunger et al. | |
| 2008/0197012 | A1 | 8/2008 | Berruti et al. | |
| 2009/0250331 | A1 | 10/2009 | Hopkins et al. | |
| 2010/0077711 | A1 | 4/2010 | Weigelt | |
| 2010/0294700 | A1 | 11/2010 | Coates et al. | |
| 2011/0035998 | A1 | 2/2011 | Badger et al. | |
| 2012/0006669 | A1 | 1/2012 | Bronshtein et al. | |
| 2012/0055775 | A1 | 3/2012 | Manderson et al. | |
| 2012/0318716 | A1 | 12/2012 | Wheeler | |
| 2013/0068587 | A1 | 3/2013 | Wheeler | |
| 2015/0368564 | A1 | 12/2015 | Wheeler et al. | |
| 2016/0053184 | A1 | 2/2016 | Wheeler et al. | |

FOREIGN PATENT DOCUMENTS

| | | |
|---|---|---|
| CA | 1120418 | 3/1982 |
| CA | 1129195 | 8/1982 |
| CA | 1221047 | 4/1987 |
| CA | 1316344 | 4/1993 |
| CA | 1334129 | 1/1995 |
| CA | 2200525 | 10/1997 |
| CA | 2151792 | 3/1999 |
| CA | 2315774 | 9/1999 |
| CA | 2799751 | 11/2011 |
| CA | 2750129 | 2/2013 |
| CA | 2783608 | 1/2014 |
| EP | 1106672 | 3/2004 |
| GB | 1534302 | 11/1978 |
| GB | 2150271 | 6/1985 |
| WO | 9746843 | 12/1997 |
| WO | 2011143770 | 11/2011 |
| WO | 2012069501 | 5/2012 |
| WO | 2014121368 | 8/2014 |

OTHER PUBLICATIONS

English Abstract of JP2008122043(A), "Rotary Kiln Furnace", published on May 29, 2005.

English Abstract of SU889089(A1), "Apparatus for Obtaining Magnesium Compounds", published on Dec. 15, 1981.

Fortuna et al., "Pilot-scale experimental pyrolysis plant: mechanical and operational aspects", Journal of Analytical Applied Pyrolysis, 40-41 (Jan. 24, 1997) 403-417.

* cited by examiner

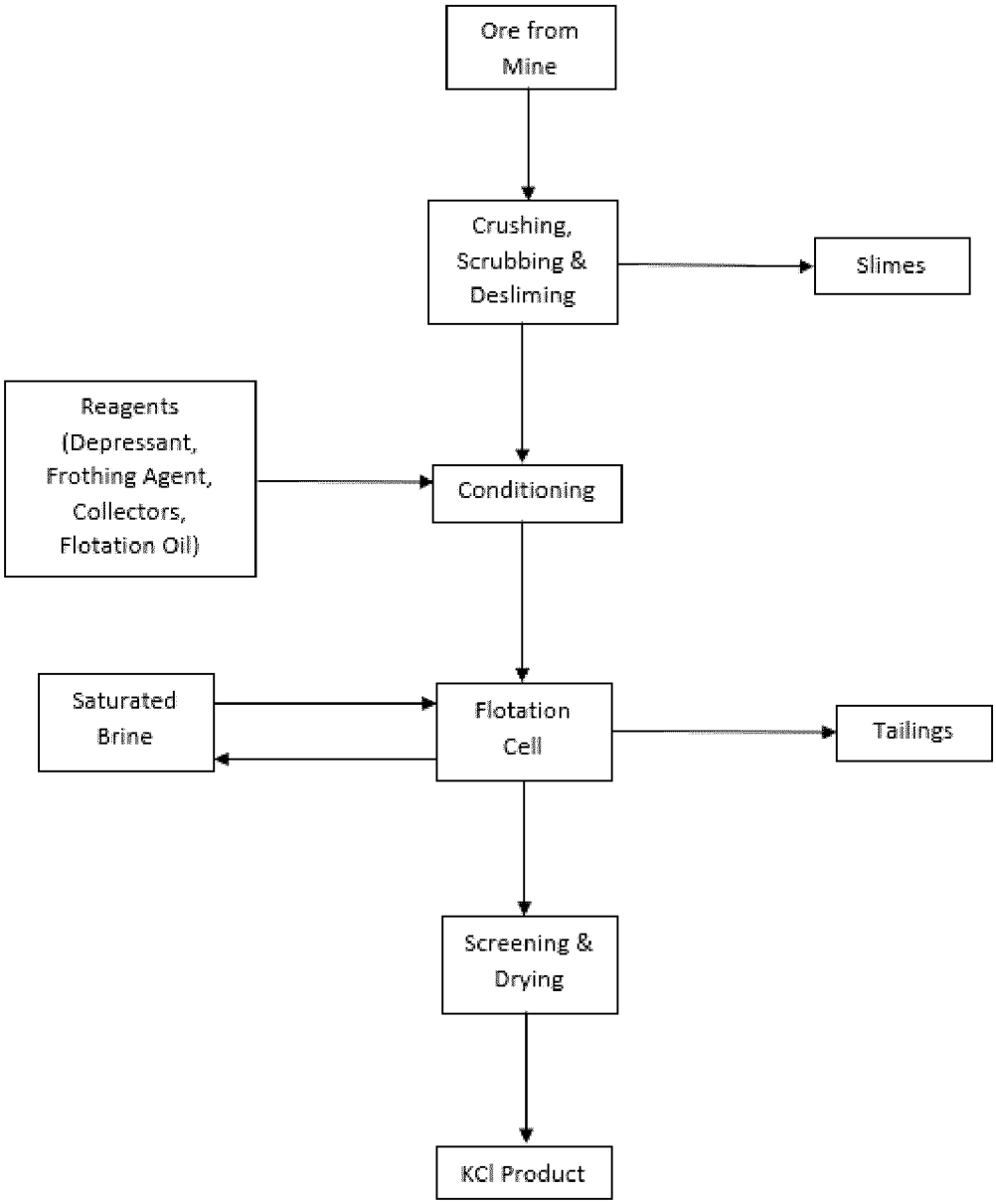
Ore from Mine
Crushing, Scrubbing & Desliming
Slimes
Reagents (Depressant, Frothing Agent, Collectors, Flotation Oil)
Conditioning
Saturated Brine
Flotation Cell
Tailings
Screening & Drying
KCl Product

FLOTATION OILS, PROCESSES AND USES THEREOF

CROSS-REFERENCE TO RELATED APPLICATIONS

The present application is a 35 USC 371 national stage entry of PCT/CA2020/050129 filed on Feb. 4, 2020 and which claims priority to Canadian Patent application No. 3,032,769, filed on Feb. 4, 2019. These document are hereby incorporated by reference in their entirety.

FIELD

The present disclosure relates to flotation oils, processes for making such flotation oils, and uses thereof for example in the froth flotation of ores such as sylvinite ores to recover potassium chloride.

BACKGROUND

Froth flotation is a process commonly used to recover desirable minerals from ores and generally comprises at least some of the following steps: ore crushing; scrubbing, desliming; conditioning; flotation; concentrate washing; filtration and drying. Froth flotation is accomplished by aerating the ore pulp (e.g. ore particles mixed with a saturated brine solution) to produce a froth at the surface. Minerals adhering to the froth are removed and further processed. A variety of chemicals may be added to the ore particles or pulp to assist in flotation. For instance, as described in US Patent Publication No. US20060226051A1, the following chemicals may be added: a carrier which is generally a liquid vehicle for the ore particles; a depressant chemical that can interact with undesirable material; a collector chemical (e.g. amines) that can interact with the desired material; an extender chemical that can assist the collector chemical in floating the desired material; a frother chemical that can assist in generating a froth of air bubbles and/or can aid dispersion of the collector; and a flocculent chemical that can affect the agglomeration of the separated undesired material.

Potassium chloride, commonly referred to as potash, Muriate of Potash (MOP) or sylvite, is a naturally occurring mineral and the most widely used potassium fertilizer. It is manufactured primarily from sylvinite ores, which consists mainly of sodium chloride (halite) and potassium chloride (sylvite), along with small amounts of carnallite (hydrated KMgCl3) and water insoluble minerals (slimes). Potash is sold on the basis of its potassium oxide ($K_2O$) equivalent content: pure potassium chloride contains 63.17% K2O equivalent. Potash is commonly recovered using the flotation process.

As described by Perucca (2003), sylvinite ores from Saskatchewan mines typically contain on average 30% sylvite (KCl), as well as halite (NaCl), some carnallite (hydrated $KMgCl_3$), and up to 5.5% water insolubles. Run-of-mine ores are produced underground by continuous miners, with sizes up to 1,500 mm, and are usually processed in a primary jaw crusher to reduce the largest lumps to the 150-250 mm range to avoid problems during transportation to the surface. Liberation of the minerals can be obtained for example using dry or wet crushing methods. In particular, liberation is substantial at 9.5 mm for the Esterhazy member ore, and at 1.2 mm for the Patience Lake member ores.

After crushing, the ore is scrubbed through a series of highly agitated cells, normally at high percent solids (e.g. 60 to 70% solids in a KCl—NaCl saturated brine), designed to remove the insoluble slime from the potash ores. After scrubbing, primary separation of the insolubles is achieved with cyclones, siphon-sizers or wet screens, while the secondary separation is usually accomplished with hydro-separators, cyclones, and thickeners (Arsentiev and Leja, 1977). Desliming of insoluble slimes from the ores can also be achieved for example by flotation in two stages: a flocculant is added to the minus 100-mesh fraction to increase the size of the slime particles prior to flotation, slime flocs are conditioned with a collector and floated in a conventional flotation cells (Perucca and Cormode, 1999). Desliming by two-stage flotation process has the advantage of reduced capital cost for the desliming equipment but suffers disadvantages from higher reagent costs (Banks, 1979). Desliming is desired to minimize the reagent costs and ensure the good quality potash recovery.

Coarse and fine material streams are conditioned separately. Both streams are conditioned with a depressant and a potash collector. An extender oil is added to the coarse conditioner. Alcohols may be used to promote froth; and a polyelectrolyte modifier or slime depressant may be applied to reduce amine adsorption on clay surfaces.

Both coarse and fine materials may be floated using conventional (e.g. Denver DR-type) flotation cells. The flotation circuits consist typically of three stages: rougher, scavenger, and cleaner. Rougher flotation is the first separation step and removes the fast-floating valuables. The rougher concentrate is sent to cleaners and recleaners to improve the grade of the rougher products, and/or treat slow-floating valuables. Scavenger treat tailings from the other stages and its concentrate are typically re-circulated as rougher feed.

De-brining is usually achieved with screen-bowl type centrifuges and the moisture of the concentrate is reduced to 4 to 5%. Flotation tails are thickened in hydro cyclones before being disposed of.

There remains however a need for a flotation oil (also referred to as an extender or extender oil) free of at least one of the drawbacks of existing flotation oil formulations. There is also a need for a less toxic flotation oil, preferably made from waste products. There is further a need for a flotation oil having increased overall extraction efficiency when used for the production of potassium salts but also for the production of other minerals and metals such as phosphate, lime, sulfate, gypsum, iron, platinum, gold, palladium, titanium, molybdenum, copper, uranium, chromium, tungsten, manganese, magnesium, lead, zinc, clay, coal, bitumen, silver, fluorite, tantalum, tin, graphite, nickel, bauxite, borax, or borate.

There is additionally a particular need for flotation oils that possess at least one of the following properties:

- float coarser minerals (e.g. potash);
- reduce tailings;
- contain less reportable polyaromatic hydrocarbons (PAHs);
- safe to transport and use (e.g. not considered dangerous goods pursuant to the Transportation of Dangerous Goods Act and Regulations, and having a lower WHMIS (Workplace Hazardous Materials Information System) classification);
- easier and safer to handle and store (e.g. pour point (as measured by ASTM D-97)<0° C. & flash point (as measured by ASTM D-93)>75° C.);
- leave less residues (i.e. gums, sludge, sediments) in flotation oil systems and tanks that must be cleaned out and disposed of;

adaptable to different flotation cells and operating conditions, for example, can be optimized for summer and winter operations; and cost effective.

SUMMARY OF THE DISCLOSURE

In accordance with an aspect herein disclosed, there is provided a flotation oil comprising at least one of the following components:

a. a heavy oil having a specific gravity (SG) equal or greater than 0.87, the heavy oil having been hydrocracked and/or hydrotreated before being thermally and/or catalytically cracked;

b. a thermally and/or catalytically cracked waste oil;

c. an intermediate stream obtained from an upgrader, a refinery, a slop or slurry tank of gasoil and/or heavier streams;

d. a thermally or catalytically cracked plastic; and wherein the flotation oil comprises at least one of the following properties:

a density at 15° C., as measured by ASTM-D4052, of about 0.87 g/ml to about 1.2 g/ml;

a flash point, as measured by ASTM D93, that is equal to or greater than 50° C.; and a resin content, as measured by SARA (Determination of Saturates, Aromatics, Resins, and Asphaltenes (SARA) as measured by IP-469), of about 2 wt. % to about 25 wt. %.

Another aspect herein disclosed relates to a process for preparing a flotation oil, comprising mixing together at least two of the following components to obtain the flotation oil:

a. a heavy oil having a specific gravity (SG) equal or greater than 0.87, the heavy oil having been hydrocracked and/or hydrotreated before being thermally and/or catalytically cracked;

b. a thermally and/or catalytically cracked waste oil;

c. an intermediate stream obtained from an upgrader, a refinery, or a slop or slurry tank of gasoil and/or heavier streams; and d. a thermally or catalytically cracked plastic, wherein the flotation oil comprises at least one of the following properties:

a density at 15° C., as measured by ASTM-D4052, of about 0.87 g/ml to about 1.2 g/ml;

a flash point, as measured by ASTM D92, that is equal to or greater than 50° C.; and a resin content, as measured by SARA (Determination of Saturates, Aromatics, Resins, and Asphaltenes (SARA) as measured by IP-469), of about 2 wt. % to about 25 wt. %.

In accordance with another aspect herein disclosed there is provided a use of the flotation oil herein disclosed or the flotation oil obtained by the process herein disclosed, for recovering potash from ores containing potash.

Also disclosed herein in a further aspect is a process for recovering at least one mineral or metal comprised in ores, comprising:

providing ores containing the at least one desirable mineral or metal;

crushing the ores to obtain ore particles suitable size for flotation;

scrubbing the ore particles;

desliming the ore particles;

conditioning the ore particles to form an ore slurry, the conditioning comprising contacting the ore particles with the flotation oil herein disclosed or the flotation oil obtained by the process herein disclosed;

floating the at least one mineral comprised in slurry; and recovering the at least one mineral or metal.

In another aspect there is provided herein a process for recovering potash, comprising:

providing ores containing potash;

crushing the ores to obtain ore particles suitable size for flotation;

scrubbing the ore particles;

desliming the ore particles;

conditioning the ore particles to form an ore slurry, the conditioning comprising contacting the ore particles with the flotation oil herein disclosed or the flotation oil obtained by the process herein disclosed;

floating the potash comprised in slurry; and recovering the potash.

BRIEF DESCRIPTION OF THE DRAWINGS

FIG. 1 is a block diagram of a potash mill showing where, in the process, the flotation oil is injected, in accordance with one embodiment.

DETAILED DESCRIPTION

The terms "heavy oil" or "bitumen" mean a viscous and dense dark hydrocarbon mixture that can be liquid, solid or semi-solid at ambient conditions.

As used herein "thermally or catalytically cracked waste oil" refer to waste oils and mixtures thereof that underwent thermal treatment either in the presence or absence of catalysts.

The term "intermediate stream" means an oil that is neither a feedstock nor a product in an upgrader or refinery.

As used herein, "additive" means a product used to change the properties of an oil, for example gasoil products, a commercial tackifier, and/or a pour point depressant.

In understanding the scope of the present disclosure, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. The term "consisting" and its derivatives, as used herein, are intended to be closed terms that specify the presence of the stated features, elements, components, groups, integers, and/or steps, but exclude the presence of other unstated features, elements, components, groups, integers and/or steps. The term "consisting essentially of", as used herein, is intended to specify the presence of the stated features, elements, components, groups, integers, and/or steps as well as those that do not materially affect the basic and novel characteristic(s) of features, elements, components, groups, integers, and/or steps.

Terms of degree such as "about" and "approximately" as used herein mean a reasonable amount of deviation of the modified term such that the end result is not significantly changed. These terms of degree should be construed as including a deviation of at least ±5% or at least ±10% of the modified term if this deviation would not negate the meaning of the word it modifies.

Tests, using a wide range of flotation oil components herein described, were carried out using both laboratory and commercial flotation cells. Surprisingly, certain flotation oil formulations were found to greatly improve the recovery and quality of potash from potash containing ores.

The flotation oil components may include a mixture of heavy oils or bitumen (specific gravity (SG)>0.87) that were either hydrocracked, or hydrotreated before being thermally and/or catalytically cracked. They can also include thermally or catalytically cracked waste oils, preferably used lubricating oils. The properties of the presently disclosed flotation oils were modified according to the mine's flotation oil specifications using for example additives such as gasoil products, a commercial tackifier, and/or a pour point depressant.

Accordingly, the flotation oil disclosed herein comprises at least one of:

- heavy oils or bitumen (SG>0.87) that were either hydrocracked, or hydrotreated before being thermally and/or catalytically cracked;
- thermally or catalytically cracked waste oils, preferably used lubricating oils;
- intermediate stream from an upgrader or refinery, or even come from a slop or slurry tank of gasoil and heavier streams;
- thermally or catalytically cracked plastics, preferably waste plastics; and
- optionally, additives, preferably at least one additive selected among: vacuum pitch (SG>1.0), gasoils (SG>0.75), tackifiers, pour point suppressants, and odour modifiers.

The flotation oil disclosed herein also comprises at least one of the following properties:

- a density at 15° C., as measured by ASTM-D4052, of about 0.87 g/ml to about 1.2 g/ml and preferably from 0.93 g/ml to 1.1 g/ml;
- a flash point, as measured by ASTM D93, that is equal to or greater than 75° C., preferably equal to or greater than 80° C., and more preferably that is equal to or greater than 90° C.;
- a resin content, as measured by SARA (Determination of Saturates, Aromatics, Resins, and Asphaltenes (SARA) as measured by IP-469, of about 2 wt. % to about 25 wt. %, about 4 wt. % to about 20 wt. %, or about 5 wt. % to about 18 wt. %.

For example, the flotation oil further comprises:

e. an additive.

For example, the additive is chosen from a vacuum pitch having a specific gravity (SG) greater than 1.0, a gasoil having a specific gravity (SG) greater than 0.75, a tackifier, a pour point suppressant and an odour modifier.

For example, the thermally and/or catalytically cracked waste oil is a lubricating oil.

For example, the thermally and/or catalytically cracked plastic comprises waste plastic and/or used plastic.

For example, the flotation oil comprises a density at 15° C., as measured by ASTM-D4052, of about 0.93 g/ml to about 1.1 g/ml.

For example, the flotation oil comprises a flash point, as measured by ASTM D93, that is greater than 55° C.

For example, the flotation oil comprises a flash point, as measured by ASTM D93, that is greater than 60° C.

For example, the flotation oil comprises a resin content, as measured by SARA (Determination of Saturates, Aromatics, Resins, and Asphaltenes (SARA) by IP-469), of about 4 wt. % to about 20 wt. %.

For example, the flotation oil comprises a resin content, as measured by SARA (Determination of Saturates, Aromatics, Resins, and Asphaltenes (SARA) by IP-469), of about 5 wt. % to about 18 wt. %.

For example, the resin is a polarized resin.

For example, the resin contained in the flotation oil disclosed herein is a polarized resin. As used herein, polarized resin refers to a polarized hydrocarbon having at least 5 carbon atoms, and preferably up to 1000 carbon atoms. For example, the resin, optionally the polarized resin, is obtained from oil, plastics and/or other organic material.

Ambient temperature fluctuations between summer (e.g. higher temperatures) and winter (e.g. lower temperatures) affect sylvite flotation. Brine equilibrium is temperature dependent, increased temperature increases solubility of the amine (Gefvert, 1987) and salts.

For example, the flotation oil comprises a heavy oil content of about 0 wt. % to about 100 wt. %

For example, the flotation oil comprises a heavy oil content of about 10 wt. % to about 100 wt. %.

For example, the flotation oil comprises a heavy oil content of about 30 wt. % to about 100 wt. %.

For example, the heavy oil is chosen from oils that were substantially saturated or subjected to a hydrotreatment before or while being cracked.

For example, the flotation oil comprises a thermally and/or catalytically cracked waste oil content that of about 0 wt. % to about 100 wt. %.

For example, the flotation oil comprises a thermally and/or catalytically cracked waste oil content of about 30 wt. % to about 90 wt. %.

For example, the flotation oil comprises an intermediate stream content of about 0 wt. % to about 100 wt. %.

For example, the flotation oil comprises an intermediate stream content of about 10 wt. % to about 100 wt. %.

For example, the flotation oil comprises an intermediate stream content of about 20 wt. % to about 100 wt. %.

For example, the flotation oil comprises an additive content of about 0 wt. % to about 70 wt. %.

For example, the flotation oil comprises:

- a density at 15° C., as measured by ASTM-D4052, of about 0.92 g/ml to about 1.1 g/ml;
- a kinematic viscosity at 40° C., that ranges between 10 cSt and 500 cSt;
- a flash point, as measured by ASTM D-93, that is greater than 50° C.;
- a resin content, as measured by SARA (Determination of Saturates, Aromatics, Resins, and Asphaltenes (SARA) as measured by IP-469), that is equal to or greater than 5 wt. %.

For example, the heavy oil comprises:

- a density at 15° C., as measured by ASTM-D4052, of about 0.87 g/ml to about 1.2 g/ml;
- a kinematic viscosity at 40° C., of about 10 cSt to about 1000 cSt;
- a flash point, as measured by ASTM D-93, that is greater than 50° C.; and
- a resin content, as measured by SARA (Determination of Saturates, Aromatics, Resins, and Asphaltenes (SARA) as measured by IP-469), of about 0 wt. % to about 25 wt. %.

For example, the intermediate stream comprises:

- a density at 15° C., as measured by ASTM-D4052, of about 0.87 g/ml to about 1.2 g/ml;
- a kinematic viscosity at 40° C., of about 10 cSt to about 1000 cSt;

a flash point, as measured by ASTM D-92 that is greater than 50° C.; and a resin content, as measured by SARA (Determination of Saturates, Aromatics, Resins, and Asphaltenes (SARA) as measured by IP-469), of about 0 wt. % to about 25 wt. %.

For example, the thermally or catalytically cracked waste oil is a used lubricating oil and comprises:

a density at 15° C., as measured by ASTM-D4052, of about 0.87 g/ml to about 1.0 g/ml;

a kinematic viscosity at 40° C., of about 10 cSt to about 200 cSt;

a flash point, as measured by ASTM D-93, that greater than 50° C.; and a resin content, as measured by SARA (Determination of Saturates, Aromatics, Resins, and Asphaltenes (SARA) as measured by IP-469), that ranges between 0 wt. % and 25 wt. %.

For example, the thermally or catalytically cracked plastic comprises waste plastic and/or used plastic and comprises:

a density at 15° C., that ranges of about 0.85 g/ml to about 1.5 g/ml;

a flash point, as measured by ASTM D-93 that is above 50° C.; and.

a resin content, as measured by SARA (Determination of Saturates, Aromatics, Resins, and Asphaltenes (SARA) as measured by IP-469), of about 0 wt. % to about 60 wt %.

Sylvite flotation also depends upon the formation of insoluble collector species, therefore, longer chain amine blends may be employed in the summer to counteract the increased amine solubility due to higher temperatures. The sylvite flotation further depends upon the interaction of the collector species with the flotation oil, and as such, the latter may be modified for summer and winter operations.

For example, the flotation oil is in a liquid phase at a temperature above 10° C.

For example, the flotation oil is in a liquid phase at a temperature above 15° C.

For example, the flotation oil is in a liquid phase at a temperature of about 15° C. to about 100° C.

For example, the flotation oil is in a liquid phase at a temperature of about 15° C. to about 150° C.

For example, the flotation oil is in a liquid phase at a temperature of about 10° C. to about 200° C.

The presently disclosed flotation oil can be further optimized to suit different mine's flotation cell operating conditions as well as ore composition and sizes.

For example, the process further comprises mixing:

e. an additive.

For example, the process comprises mixing together the following components:

a+b;
a+c;
a+d;
a+e;
b+c;
b+d;
b+e;
c+d;
c+e;
d+e;
a+b+c;
a+b+d;
a+b+d;
a+c+d;
a+c+e;
b+c+d;
b+c+e;
c+d+e; or
a+b+c+d.

For example, the mixing is performed at a temperature of about 15° C. to about 95° C.

For example, the mixing is performed at a temperature of about 20° C. to about 90° C.

For example, the mixing is performed at a temperature of about 40° C. to about 70° C.

For example, the mixing is achieved using mechanical means.

For example, the mixing is achieved using a mixer.

For example, the mixer operates at a speed of about 10 rpm to about 1500 rpm.

For example, the mixer operates at a speed of about 20 rpm to about 200 rpm.

For example, the mixer comprises a pump operating at a rate of about 1 US gal/min to about 100 US gal/min.

For example, the mixer comprises a pump operating at a rate of about 10 US gal/min to about 80 US gal/min.

For example, the duration of the mixing ranges of about 10 minutes to about 5 days.

For example, the duration of the mixing ranges of about 1 hour to about 2 days.

For example, the additive is chosen from a vacuum pitch having a specific gravity (SG) greater than 1.0, a gasoil having a specific gravity (SG) greater than 0.75, a tackifier, a pour point suppressant and an odour modifier.

For example, the thermally and/or catalytically cracked waste oil is a thermally and/or catalytically cracked lubricating oil.

For example, the thermally and/or catalytically cracked plastic comprises waste plastic and/or used plastic.

For example, the flotation oil comprises a density at 15° C., as measured by ASTM-D4052, of about 0.93 g/ml to about 1.1 g/ml.

For example, the flotation oil comprises a flash point, as measured by ASTM D93, that is greater than 55° C.

For example, the flotation oil comprises a flash point, as measured by ASTM D93, that is greater than 60° C.

For example, the flotation oil comprises a resin content, as measured by SARA (Determination of Saturates, Aromatics, Resins, and Asphaltenes (SARA) as measured by IP-469), of about 4 wt. % to about 20 wt. %.

For example, the flotation oil comprises a resin content, as measured by SARA (Determination of Saturates, Aromatics, Resins, and Asphaltenes (SARA) as measured by IP-469), of about 5 wt. % to about 18 wt. %

For example, the resin is a polarized resin.

For example, the flotation oil comprises a heavy oil content of about 0 wt. % to about 100 wt. %.

For example, the flotation oil comprises a heavy oil content of about 10 wt. % to about 100 wt. %.

For example, the flotation oil comprises a heavy oil content of about 30 wt. % to about 100 wt. %.

For example, the heavy oil is chosen from oils that were substantially saturated or subjected to a hydrotreatment before or while being cracked.

For example, the flotation oil comprises a thermally and/or catalytically cracked waste oil content of about 0 wt. % to about 100 wt. %.

For example, the flotation oil comprises a thermally and/or catalytically cracked waste oil content of about 30 wt. % to about 90 wt. %.

For example, the flotation oil comprises an intermediate stream content of about 0 wt. % to about 100 wt. %.

For example, the flotation oil comprises an intermediate stream content of about 10 wt. % to about 100 wt. %.

For example, the flotation oil comprises an intermediate stream content of about 20 wt. % to about 100 wt. %.

For example, the flotation oil comprises an additive content of about 0 wt. % to about 70 wt. %.

For example, the flotation oil comprises:

- a density at 15° C., as measured by ASTM-D4052, of about 0.92 g/ml to about 1.1 g/ml;
- a kinematic viscosity at 40° C., of about 10 cSt to about 500 cSt;
- a flash point, as measured by ASTM D-93, that is greater than 50° C.;
- a resin content, as measured by SARA (Determination of Saturates, Aromatics, Resins, and Asphaltenes (SARA) as measured by IP-469), that is equal to or greater than 5 wt. %.

For example, the heavy oil comprises:

- a density at 15° C., as measured by ASTM-D4052, of about 0.87 g/ml to about 1.2 g/ml;
- a kinematic viscosity at 40° C., of about 10 cSt to about 1000 cSt;
- a flash point, as measured by ASTM D-93, that is greater than 50° C.; and
- a resin content, as measured by SARA (Determination of Saturates, Aromatics, Resins, and Asphaltenes (SARA) as measured by IP-469), of about 0 wt. % to about 25 wt. %.

For example, the intermediate stream comprises:

- a density at 15° C., as measured by ASTM-D4052, of about 0.87 g/ml to about 1.2 g/ml;
- a kinematic viscosity at 40° C., of about 10 cSt to about 1000 cSt;
- a flash point, as measured by ASTM D-92 that is greater than 50° C.; and
- a resin content, as measured by SARA (Determination of Saturates, Aromatics, Resins, and Asphaltenes (SARA) as measured by IP-469), of about 0 wt. % to about 25 wt. %.

For example, the thermally or catalytically cracked waste oil is a used lubricating oil and comprises:

- a density at 15° C., as measured by ASTM-D4052, of about 0.87 g/ml to about 1.0 g/ml;
- a kinematic viscosity at 40° C., of about 10 cSt to about 200 cSt;
- a flash point, as measured by ASTM D-93, that greater than 50° C.; and
- a resin content, as measured by SARA (Determination of Saturates, Aromatics, Resins, and Asphaltenes (SARA) as measured by IP-469), that ranges between 0 wt. % and 25 wt. %.

For example, the thermally or catalytically cracked plastic comprises waste plastic and/or used plastic and comprises:

- a density at 15° C., that ranges of about 0.85 g/ml to about 1.5 g/ml;
- a flash point, as measured by ASTM D-93 that is above 50° C.; and.
- a resin content, as measured by SARA (Determination of Saturates, Aromatics, Resins, and Asphaltenes (SARA) as measured by IP-469), of about 0 wt. % to about 60 wt. %.

The following examples are given as a matter of exemplification and should not be construed as bringing any limitation to the present disclosure in its broadest scope.

EXAMPLES

Example 1—Formulation 1: Mixture of Refinery and Upgrader Oils

Formulation 1 is a mixture of cracked refinery and cracked upgrader oils with a specific gravity (SG)>0.87. The performance of Formulation 1 was compared to a reference flotation oil A obtained from refinery heavy fuel oil streams. Testing was performed using a commercial flotation unit.

Formulation 1 was Made Up of Two Components:

- Component A (45 wt. %) is a gas oil product, produced from a heavy oil that was hydrotreated before being thermally cracked.
- Component B (55 wt. %) is a heavy gas oil, a blend of catalytic cracking gas oil and vacuum pitch. Both these oils originate from a heavy oil that was hydrotreated prior to being fed to a catalytic cracker or to a vacuum distillation column.

When tested using simulated distillation as measured by ASTM D2887, Formulation 1 comprised the following:

- 17 wt. % material with boiling temperatures in the atmospheric gas oil range
- 79 wt. % material with boiling temperatures in the vacuum gasoil range, and
- 4 wt. % light pitch material.

Formulation 1 had a density of about 1020 kg/m$^3$ at 15° C., as measured by ASTM D-4052. Its initial boiling temperatures higher than those of the reference oil A suggests that Formulation 1 was safer to handle with reduced risks of health and safety issues related to volatile organic compounds (VOCs). Formulation 1 was more viscous than the reference oil A but still flowed easily. The reference oil A had a viscosity of 15 cSt while Formulation 1 had a viscosity of about 85 cSt, as measured by ASTM D-445 at 40° C.

Formulation 1 and the reference oil A were compared, as described in Table 1, in an operating flotation cell in a potash mine, keeping all other operating conditions constant. This included the flotation cell's feed throughput and quality, temperature, other reagents' injection rates while using the same saturated brine, characterized throughout the experiment.

It was found that Formulation 1 floated 16.5% more coarse potash crystals, resulting in 22% reduction in the final tailings, and thus increased the total recovery by 7%.

Furthermore, with less than 30% of the carcinogenic polyaromatic hydrocarbons (PAHs) found in the reference oil A, Formulation 1 would only be classified as a Toxic Material (WHMIS—D2B) while the reference oil A is classified as Very Toxic Material (WHMIS—D2A).

TABLE 1

| | ASTM Method | Reference Oil A | Formulation 1 | Unit |
|---|---|---|---|---|
| SG @ 15.6° C. | D-4052 | 1.02 | 1.02 | |
| Viscosity @ 40° C. | D-445 | 15 | 85 | cSt |
| Flash Point | D-93 | >100 | >100 | ° C. |
| Resins | SARA | 4 | 9 | |
| Coarse KCl Recovered | | 22 | 25 | wt. % |
| Tailings | | 0.67 | 0.52 | wt. % |
| Total KCl Recovery | | 80 | 85 | wt. % |

Example 2—Formulation 2: A Mixture of Refinery and Upgrader Oils

For this test, Formulation 2 was made up of two components:

Component A (90 wt. %) is a gas oil product, produced from a heavy oil that was hydrotreated before being thermally cracked.

Component B (10 wt. %) is a heavy gas oil, a blend of catalytic cracking gas oil and vacuum pitch. Both these oils originate from a heavy oil that was hydrotreated prior to being fed to a catalytic cracker or to a vacuum distillation column.

Formulation 2 is a mixture of refinery and upgrader oils with SG>0.87. It comprises the same feed components as Formulation 1 described in Example 1 but with varied proportion of each component to prepare the desired specific gravity. The performance of Formulation 2 was compared to a reference flotation oil B obtained from refinery heavy fuel oil streams, with the tests performed at a commercial flotation unit of a different mine.

As described in Table 2, Formulation 2 was less dense than the reference oil B, with a specific gravity of 0.95 as opposed to 1.01 for the reference oil B. Formulation 2 was more viscous than the reference oil B, but still flowed easily.

The coarse KCl recovered using Formulation 2 was comparable to that of the reference oil B at 58.3% and 58.6%, respectively. Moreover, the average rougher tails were reduced from 2.3% K2O using the reference oil B to 1.5% with Formulation 2, i.e. a forty percent reduction. Furthermore, Formulation 2 is safer to handle with less than 40% of the PAHs found in the reference oil B, which are known carcinogens.

TABLE 2

| Test | ASTM Method | Reference Oil B | Formulation 2 | Units |
|---|---|---|---|---|
| SG @ 15.6° C. | D-4052 | 1.01 | 0.95 | |
| Viscosity @ 40 C. | D-445 | 16 | 30 | cSt |
| Flash Point | D-93 | >100 | 96 | C. |
| Resins | SARA | 4 | 9 | wt. % |
| Coarse Float | | 58.6 | 58.3 | % K2O |
| Rougher Tail | | 2.3 | 1.5 | % K2O |

Example 3—Formulation 3: A Mixture of Refinery and Upgrader Oils

Formulation 3 is a mixture of refinery and upgrader oils with SG>0.87. There was a need to customize the flotation oil to suit different flotation unit processes, operating conditions, and reagents.

For this test, Flotation 3 was made up of two components:

Component A (50 wt. %) is a gas oil product, produced from a heavy oil that was hydrotreated before being thermally cracked.

Component C (50 wt. %) is a gas oil produced in a refinery catalytic cracker.

The performance of Formulation 1 from Example 1 was compared to Formulation 3 in a pilot plant flotation cell at a different mine, keeping all other operating conditions constant. This included the flotation cell's feed throughput and quality, temperature, other reagents' injection rates, while using the same saturated brine throughout the experiment.

The specific gravity of Formulations 1 and 3 is similar. Formulation 3 has a higher flash point (180° C. vs.>100° C.) compared to Formulation 1 (Example 1). This is due to major components of Formulation 3 being produced in fractionators while only one of the components of Formulation 1 has been submitted to fractionation.

Using customized flotation oil formulations, the total potash recovery was increased from 83% in Formulation 1 to up to 93% in Formulation 3, as described in Table 3.

TABLE 3

| Test | ASTM Method | Reference Oil C | Formulation 1 | Formulation 3 | Units |
|---|---|---|---|---|---|
| SG @ 15.6° C. | D-4052 | 1.00 | 1.02 | 1.02 | |
| Viscosity @ 40 C. | D-445 | 37 | 79 | 68 | cSt |
| Flash Point | D-92 | 151 | 148 | 180 | C. |
| Resins | SARA | 8.3 | 10.4 | 10.1 | wt. % |
| KCl Recovery | Run 1 | 84 | 83 | 93 | wt. % |
| | Run 2 | | | 92 | |

Example 4—Formulation 4: Mixture of Fuel Oil from Thermally Cracked Waste Oil and Refinery and/or Upgrader Heavy Oil Formulation 4 in this example is a mixture of fuel oil from thermally cracked waste oil and refinery and/or upgrader heavy oil. Its performance was compared to a reference flotation oil D obtained from refinery heavy fuel oil streams, with the experiments being performed in a laboratory flotation unit.

For this test, Formulation 4 was made up of two components:

Component B (70 wt. %) is a heavy gas oil, a blend of catalytic cracking gas oil and vacuum pitch. Both these oils originate from a heavy oil that was hydrotreated prior to being fed to a catalytic cracker or to a vacuum distillation column.

Component D (30 wt. %) is a heavy oil produced from thermally cracked used lubricating oil.

Formulation 4 and the reference oil D have similar densities, but Formulation 4 is more viscous than the reference oil D due to a higher resin content. Both have a density of about 1020 kg/m$^3$ at 15.6° C., as measured by ASTM D-4052. The reference oil has a viscosity of 12 cSt while Formulation 4 has a viscosity of about 264 cSt, as measured by ASTM D-445 at 40° C.

Both Formulation 4 and the reference oil D were compared in an operating potash mine's flotation cell, keeping all other operating conditions constant. This included the flotation cell's feed throughput and quality, temperature, other reagents' injection rates while using the same saturated brine, characterized throughout the experiment.

As described in Table 4, Formulation 4 increased the total KCl recovery by 12%. Furthermore, it contains less sulfur and sediment, which reduces fouling of the flotation oil system and tanks.

TABLE 4

| Test | ASTM Method | Reference Oil D | Formulation 4 | Units |
|---|---|---|---|---|
| SG @ 15.6° C. | D-4052 | 1.02 | 1.02 | |
| Viscosity @ 40 C. | D-445 | 12 | 264 | cSt |
| Flash Point | D-93 | >100 | 76 | C. |
| Sulfur | D-1552 | 1.25 | | wt. % |
| Sediment | D-96 | 0.4 | 0.06 | Vol % |
| Resins | SARA | 4 | 15 | wt. % |
| Approximate KCl Recovery | | 80 | 90 | wt. % |

CONCLUSION

The above examples demonstrate that when the flotation oils were tested in potash flotation cells, they increased potash recovery from about 80 wt. % to about 90 wt. %. More importantly, they increased the coarse potash (below 20 mesh or above 0.85 mm) recovery by up to 20 wt. %. This reduces the recycle stream and therefore increases total plant capacity by up to 40%. It also reduced tailings, making the mine's operations more efficient and reduces the environmental impact of the mine.

These flotation oils were tried in flotation cells used for the recovery of other material such as phosphate and copper and resulted in improved recovery (about 10 wt. %) in both cases.

Advantages of the Presently Disclosed Flotation Oils Compared with a Known Flotation Oil.

The presently disclosed flotation oils improved the recovery of potassium chloride by about 10 wt. %. Further, the recovery of coarse potassium chloride crystals was increased by about 12 wt. %. The tailings (or waste stream) decreased by about 22 wt. %.

The processes and formulations of the present disclosure surprisingly open another way to valorize inter alia waste oils, offering for example a niche market for oils having unusual characteristics, such as a high content of resins as determined by a SARA test (saturates, aromatics, resins, and asphaltenes).

The test Formulations and the two reference flotation oils were evaluated for their reportable PAH contents. The test Formulations had less than 30% reportable PAH content, compared to the reference oils. Therefore, their carcinogenicity was reduced by an average of 70%.

The WHMIS toxicity classification of tested Formulations was evaluated as class D-2B (toxic), down from class D-2A (very toxic).

All the Formulations tested had flash points above 55° C. (as measured by ASTM D-93). They can thus be safely transported.

In addition, all the tested Formulations, with the possible exception of Formulation 4, left less deposits in the tanks and piping than the reference oils.

Because the presently disclosed flotation oils may, in some examples, be mixtures of oils from a variety of sources, they can be formulated to meet specific mine ore, flotation cell type and operating condition, the kind and quantity of other reagents used, and the plant environmental conditions.

In addition, it was found that the presently disclosed flotation oils may be more cost-effective than known flotation oils.

For example, the at least one mineral or metal recovered is chosen from potash, phosphate, lime, sulfate, gypsum, iron, platinum, gold, palladium, titanium, molybdenum, copper, uranium, chromium, tungsten, manganese, magnesium, lead, zinc, clay, coal, bitumen, silver, silver, fluorite, tantalum, tin, graphite, nickel, bauxite, borax, and borate.

Although the present disclosure has been described with the aid of specific embodiments, it should be understood that several variations and modifications may be grafted onto the embodiments and that the present disclosure encompasses such modifications, usages or adaptations of the present disclosure that will become known or conventional within the field of activity to which the present disclosure pertains, and which may be applied to the essential elements mentioned above.

REFERENCES

1. Perucca C. F. (2003). "Potash Processing in Saskatchewan—A Review of Process Technologies", CIM Bulletin, Vol. 96, No. 1070.
2. Perucca C. F., and Cormode D. A. (1999), "Update on Insols Flotation at Agrium's Vanscoy Potash Plant", presented to the XXXI$^{th}$ CMP Meeting, Ottawa, pp. 183-197.
3. Gefvert D. L. (1986). "Cationic Flotation Reagents for Mineral Beneficiation", Chemical Reagents in the Mineral Processing Industry, ed. D. M. Malhotra and W. F. Riggs. SME Inc., Littleton, 85
4. Arsentiev V. A. and Leja J. (1977). "Problems in Potash Flotation Common to Ores in Canada and the Soviet Union." CIM Bulletin, vol 70, no 779, March, pp. 154-158
5. Banks A. F. (1979): "Selective Flocculation-Flotation of Slimes from Sylvinite Ores". Beneficiation of Mineral Fines, Problems and Research Needs. Somasundaran and Arbiter, Editors, SME, New York, pp. 1104-1111.

The invention claimed is:

1. A flotation oil comprising:

an intermediate stream obtained from an upgrader, a refinery, a slop, or slurry tank of gasoil and/or heavier streams, wherein the flotation oil comprises a polarized resin content, as measured by SARA (Determination of Saturates, Aromatics, Resins, and Asphaltenes (SARA) as measured by IP-469), of 2 wt. % to 25 wt. % and at least one of the following properties:

a density at 15° C., as measured by ASTM-D4052, of 0.87 g/ml to 1.2 g/ml; and a flash point, as measured by ASTM D93, that is equal to or greater than 50° C.

2. The flotation oil of claim 1, further comprising an additive.

3. The flotation oil of claim 2, wherein the additive is chosen from a vacuum pitch having a specific gravity (SG) greater than 1.0, a gasoil having a specific gravity (SG) greater than 0.75, a tackifier, a pour point suppressant and an odour modifier.

4. The flotation oil of claim 1, wherein the flotation oil comprises a density at 15° C., as measured by ASTM-D4052, of 0.93 g/ml to 1.1 g/ml.

5. The flotation oil of claim 1, wherein the flotation oil comprises a flash point, as measured by ASTM D93, that is greater than 55° C.

6. The flotation oil of claim 1, wherein the flotation oil comprises a flash point, as measured by ASTM D93, that is greater than 60° C.

7. The flotation oil of claim 1, wherein the flotation oil comprises a polarized resin content, as measured by SARA (Determination of Saturates, Aromatics, Resins, and Asphaltenes (SARA) by IP-469), of 4 wt. % to 20 wt. %.

8. The flotation oil of claim 1, wherein the flotation oil comprises a polarized resin content, as measured by SARA (Determination of Saturates, Aromatics, Resins, and Asphaltenes (SARA) by IP-469), of 5 wt. % to 18 wt. %.

9. The flotation oil of claim 1, wherein the flotation oil comprises an intermediate stream content of 10 wt. % to 100 wt. %.

10. The flotation oil of claim 1, wherein the flotation oil comprises an intermediate stream content of 20 wt. % to 100 wt. %.

11. The flotation oil of claim 2, wherein the flotation oil comprises an additive content of up to 70 wt. %.

12. The flotation oil of claim 1, wherein the flotation oil comprises:

a density at 15° C., as measured by ASTM-D4052, of 0.92 g/ml to 1.1 g/ml;

a kinematic viscosity at 40° C., that ranges between 10 cSt and 500 cSt;

a flash point, as measured by ASTM D-93, that is greater than 50° C.; and a polarized resin content, as measured by SARA (Determination of Saturates, Aromatics, Resins, and Asphaltenes (SARA) as measured by IP-469), that is equal to or greater than 5 wt. %.

13. A flotation oil comprising an intermediate stream obtained from an upgrader, a refinery, a slop or slurry tank of gasoil and/or heavier streams, wherein the intermediate stream comprises:

a density at 15° C., as measured by ASTM-D4052, of 0.87 g/ml to 1.2 g/ml;

a kinematic viscosity at 40° C., of 10 cSt to 1000 cSt;

a flash point, as measured by ASTM D-92 that is greater than 50° C.; and a polarized resin content, as measured by SARA (Determination of Saturates, Aromatics, Resins, and Asphaltenes (SARA) as measured by IP-469), of greater than 0 wt. % to 25 wt. %.

* * * * *